US006916070B2

(12) United States Patent
Sehr

(10) Patent No.: US 6,916,070 B2
(45) Date of Patent: Jul. 12, 2005

(54) LASER-BASED CONTROLLER FOR ADJUSTING THE HEIGHT OF A MACHINING TOOL OF A CONSTRUCTION MACHINE

(75) Inventor: Willibald Sehr, Hadamar/Steinbach (DE)

(73) Assignee: MOBA-Mobile Automation GmbH, Elz (DE)

( * ) Notice: Subject to any disclaimer, the term of this patent is extended or adjusted under 35 U.S.C. 154(b) by 0 days.

(21) Appl. No.: 10/433,863

(22) PCT Filed: Nov. 28, 2001

(86) PCT No.: PCT/EP01/13912

§ 371 (c)(1),
(2), (4) Date: Nov. 13, 2003

(87) PCT Pub. No.: WO02/46533

PCT Pub. Date: Jun. 13, 2002

(65) Prior Publication Data

US 2004/0068896 A1 Apr. 15, 2004

(30) Foreign Application Priority Data

Dec. 7, 2000 (DE) ..... 100 60 903

(51) Int. Cl.[7] ..... E01C 19/00
(52) U.S. Cl. ..... 299/1.5; 299/39.6; 404/84.1
(58) Field of Search ..... 299/1.05, 1.4, 299/1.5, 39.6; 404/84.1–84.8; 356/3.03–3.08

(56) References Cited

U.S. PATENT DOCUMENTS 4,456,829 A * 6/1984 Fohey ..... 250/559.23
4,796,998 A * 1/1989 Soma et al. ..... 356/608
4,922,752 A * 5/1990 Kitazume et al. ..... 73/146
4,943,119 A * 7/1990 Zarniko et al. ..... 299/1.5
4,961,173 A * 10/1990 Sehr et al. ..... 367/96
5,015,868 A * 5/1991 Park ..... 250/559.08
5,151,608 A * 9/1992 Torii et al. ..... 250/559.38
5,163,319 A * 11/1992 Spies et al. ..... 73/146
5,293,162 A * 3/1994 Bachalo ..... 340/905
5,309,407 A * 5/1994 Sehr et al. ..... 367/96
5,393,167 A * 2/1995 Fujita et al. ..... 404/84.1
5,521,694 A * 5/1996 Osterwalder ..... 356/3.08
5,753,808 A * 5/1998 Johnson ..... 73/146
5,837,997 A * 11/1998 Beck et al. ..... 250/227.11
6,371,566 B1 * 4/2002 Haehn ..... 299/1.5
6,499,339 B1 * 12/2002 Hedstrom ..... 73/81

FOREIGN PATENT DOCUMENTS

| | | |
|---|---|---|
| DE | 3827617 A1 | 2/1990 |
| DE | 3827618 A1 | 2/1990 |
| DE | 4038860 | 6/1992 |
| DE | 4341894 C1 | 7/1995 |
| EP | 0547378 | 6/1993 |
| EP | 0542297 | 4/1995 |
| WO | WO9964681 | 12/1999 |

* cited by examiner

*Primary Examiner*—John Kreck
(74) *Attorney, Agent, or Firm*—Glenn Patent Group; Michael A. Glenn

(57) ABSTRACT

A laser-regulating means for a construction machine for adjusting the height of a height-adjustable machining tool includes three laser measuring heads which are directed to three measuring points being spaced from each other on a reference surface, and an evaluating means, which, from the output signals of the laser measuring heads and from the known geometric arrangement of the laser measuring heads as regards the machining tool, determines the height of the machining tool relative to a reference surface and, from this height and from a target height determines a control signal for a height-adjustment of the machining tool. The construction machine is a road finisher with a height-adjustable plank or a cold planer with a height-adjustable milling drum.

13 Claims, 4 Drawing Sheets

LASER-BASED CONTROLLER FOR ADJUSTING THE HEIGHT OF A MACHINING TOOL OF A CONSTRUCTION MACHINE

BACKGROUND OF THE INVENTION

1. Field of the Invention

The present invention relates to a laser-regulating means for a construction machine for adjusting the height of a height-adjustable machining tool.

2. Description of the Related Art

In the building trade, and, in particular, in underground engineering, various construction machines are employed to machine and/or generate large surfaces, such that the same comprise a desired, often approximately plane profile. In road construction, these machines include, for example, a road finisher, or paver, a cold planer for road use, a "motor grader", and others. The construction machines use mechanical or electronic regulating means to facilitate a quick and cost-efficient high-quality generation of a surface with a desired profile. In the following the problems involved will be briefly discussed by means of a road finisher and a cold planer.

Generally, a road finisher operates with a crawler track gear on a prepared underground, onto which is applied a road surface, or road paving, or tarmac, yet to be finished. On the rear side of the road finisher, seen from the direction of travel, a height-adjustable plank is provided, on the front side of which a supply of paving material is piled up, which is distributed and tracked by means of a conveyor, which ensures that, on the front side of the plank, there is always a sufficient, yet not too great amount of paving material kept in supply. The height of the rear edge of the plank relative to the surface of the prepared underground, which may also be formed by a previously existing road surface, establishes the thickness of the finished road surface before the same is subsequently further compacted by means of compactors. The plank is held at a traction arm, which is mounted in a height-adjustable manner around a traction point arranged in the central area of the road finisher, with the height of the plank being adjustable via hydraulics.

In prior art road finishers, for controlling the height of the plank establishing the thickness of the paving to be finished, use is, for example, made of a mechanical scanning device guided beside the road finisher along a reference surface. Corresponding to a height of a scanning ski detected by means of an evaluating, means, the plank will be re-adjusted in height.

The reference plane, along which the scanning ski is guided, depends on the current processing operation. Typically, the operating width of a road finisher is less than the width of the road surface to be finished. For establishing the height plane of the road surface to be finished use is commonly made of a taut steel cable as a reference height for a first track of the total road surface to be finished. When laying the second track, which is to follow the first track without any displacement in height, the scanning ski is guided above the previously finished track, which then forms the reference surface. With prior art road finishers it is thus possible, through the use of a scanning ski, to use different objects as a reference plane, such as, for example, the taut reference cables and/or the previously finished track of the road surface.

However, this prior art type of height-regulating the plank comprises some system-related disadvantages. If, for example, when finishing the second track, a finished track of the road surface is used as a reference plane for guiding the scanning ski, and if the first track has a certain, undesired waviness, a second track will inevitably comprise a structure with errors, which correspond to a reproduction of the errors of the road surface in the area scanned by the scanning ski.

The mechanical scanning by means of a scanning ski inevitably follows some sort of envelope curve over the respectively highest points of the reference surface. If, there is, for example, an undesired obstacle in the form of a stone on the reference surface, the undesired deflection of the scanning ski caused by this trouble spot results in a corresponding height error of the finished track of the road surface. A further problem is based on the mechanical sensitivity of the scanning ski, which may be easily damaged not only due to careless operating personnel, but also becomes quickly worn out during normal operation.

From the U.S. Pat. No. 4,961,173 of the applicant, a control sensor for a construction machine for generating height-control signals and direction-control signals by scanning a reference cable or guide cable is known. The prior art control sensor has a plurality of ultrasound transceivers which are arranged transversally to the direction of motion of the construction machine and which are arranged adjacent to each other, such that their lobes overlap in the measuring plane in which the guide cable or the reference cable is located.

The EP 0542297 B1 describes an alternative regulating means, in which at least three ultrasound sensors are mounted at the plank essentially in the direction of motion of the road finisher and spaced from each other, and in which an evaluating means uses the distance signals of the ultrasound sensors for generating a height-control signal for adjusting the plank. Among other things, this principle allows an averaging of the surface in direction of travel and, in practice, leads to satisfactory results. Yet, it has some decisive practical disadvantages. Since the sensors have to be arranged vertically above the respective measuring points on the floor, a stable construction needs to be built along the distance to be averaged in order to keep the sensors in position. For delivering good accuracy, also the ultrasound sensors have to be mounted as close as possible (approximately 30 cm) to the reference surface. Disadvantages of this ultrasound-regulating means include the high construction requirements, the hindering of workers during activities at or near the construction machine, and the danger of mechanically damaging the sensors and the construction carrying the same in rough field conditions.

The EP 0547378 E1 describes an ultrasound regulating means for a mobile planer. An evaluating means uses the signals of at least three ultrasound sensors to generate control signals for the gear height-adjusting means depending on an adjustable target cutting depth. This apparatus provides the same disadvantages described above in conjunction with the road finisher.

The WO 99/64681 A1 describes a laser-based, regulating means for a road finisher. A laser scans the profile of the unfinished surface before applying the paving material and of the surface of the freshly applied paving material along a plane alongside the direction of motion of the road finisher and vertical to the road surface in a multitude of measuring points. From the thus obtained profile data, an evaluating means generates a control signal for controlling the plank of the road finisher. The disadvantage of this system consists in the comparably complex and sensitive mechanics of the laser scanner used.

The DE 3827617A1 describes a scanning sensor, which enables a track-like nominal plane recognition, for the purpose of which, for example, curbstones may be used. A distance, which is pre-adjustable over the same, may serve to move the machining apparatus in a desired plane-height relative to the thus generated reference plane and to automatically align the same. The scanning sensor may be based on the use of ultrasound, a laser beam or other optical scanning systems.

SUMMARY OF THE INVENTION

It is the object of the present invention to provide a constructively simpler, mechanically more robust regulating means for a construction machine, which offers a higher degree of user friendliness at the construction site, for adjusting the height of a height-adjustable machining tool.

The present invention provides a laser-regulating means for a construction machine for adjusting the height of a height-adjustable machining, tool comprising a first laser measuring head, a second laser measuring head, and a third laser measuring head, which are arranged at the construction machine, with the first laser measuring head and the second laser measuring head being arranged at a first angle to each other, with the first laser measuring head and the third laser measuring head being arranged at a second angle to each other, with the first angle and the second angle being selected such that a first measuring point of the first laser measuring head, a second measuring point of the second laser measuring head, and a third measuring point of the third laser measuring head are spaced from each other on a reference surface, with the first measuring point, the second measuring point, and the third measuring point being arranged essentially behind each other in the direction of motion of the construction machine, and an evaluating means, which, depending on output signals of the first laser measuring head, the second laser measuring head, and the third laser measuring head, determines a first distance of the first laser measuring head from the reference surface, a second distance of the second laser measuring head from the reference surface, and a third distance of the third laser measuring head from the reference surface, on the basis of the determined distances and the known geometric arrangement of the first laser measuring head, the second laser measuring head, and the third laser measuring head relative to the machining tool, calculates the height of the machining tool relative to the reference plane, and, depending on the calculated height and a target height, generates a height-control signal for the machining tool.

An advantage of the inventive regulating means consists in that the arrangement of the laser measuring heads and the arrangement of the measuring point on a reference surface are essentially independent of each other. On the one hand, therefore, the laser measuring heads may be mounted at a place, at or in the environment of the construction machine, where are no hindrance to certain jobs carried out or to workers working there, and where they are safe from any damage, for example, at a height of several meters. On the other hand, the position of the measuring points on the reference surface is essentially freely adjustable to the practical requirements.

The use of three laser measuring heads enables enhancing the regulating pcablerties of the laser-regulating means by recognizing artifacts using a simple plausibility control, the former, for example, resulting from objects on or holes in the reference surface and not having any impact on the regulation of the tool, as well as by compensating for any waviness of the reference surface by means of averaging.

A preferred embodiment of the inventive laser-regulating means further includes a fourth laser measuring head and a fifth laser measuring head which are arranged on the construction machine with a third angle and/or under a fourth angle relative to the first laser measuring head, with the third angle and fourth angle being selected such that the first measuring point, the second measuring point, the third measuring point, a fourth measuring point of the fourth laser measuring head and the fifth measuring point of the fifth laser measuring head are spaced apart from each other on the reference surface and that the measuring points are located essentially behind each other in the direction of motion of the construction machine, with the evaluating means calculating the height of the machining tool depending on a fourth distance of the fourth laser measuring head relative to the reference surface, a fifth distance of the fifth laser measuring head relative to the reference surface and the known geometric arrangement of the fourth laser measuring head and fifth laser measuring head with respect to the machining tool.

Preferably, the laser-regulating means determines the differences of two distances each and classifies those distances as valid, the difference of which is smaller than a limiting value, or discards one of the determined distances as invalid and does not use the same for generating the height-control signal, if the distance involved ranges outside a predetermined range. The predetermined range may be specified by a predetermined distance above/below a plane, with the plane being specified by the remaining distances.

Preferably, the evaluating means forms the mean value of the determined and, if necessary, not-discarded distances.

Preferably, the laser measuring heads are further adjacent to each other in spatial proximity, arranged essentially behind each other in the direction of motion and arranged essentially at equal distances to the machining tool. In this case, the total laser-regulating means may be arranged in a compact housing, such that no mechanical or electrical connection to remotely arranged sensors is required. As a result of this, disadvantages in connection with interrupted or damaged signal lines can be avoided, which occur in prior art construction machines owing to the required arrangement of the ultrasound sensors.

An advantage of the inventive laser-regulating means consists in that it does not contain any moveable or moved parts, such that the same are especially robust, less error-prone and easy to implement in terms of construction, manufacture, assembly, and maintenance. The special robustness is especially important under the conditions at a construction machine (vibrations, a very high working temperature range, humidity, etc.).

The inventive laser-regulating means is, for example, attached to a road finisher or to a cold planer.

Preferably, one of the laser measuring heads is aligned with the pertaining measuring point and the machining tool

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

Figure 1:
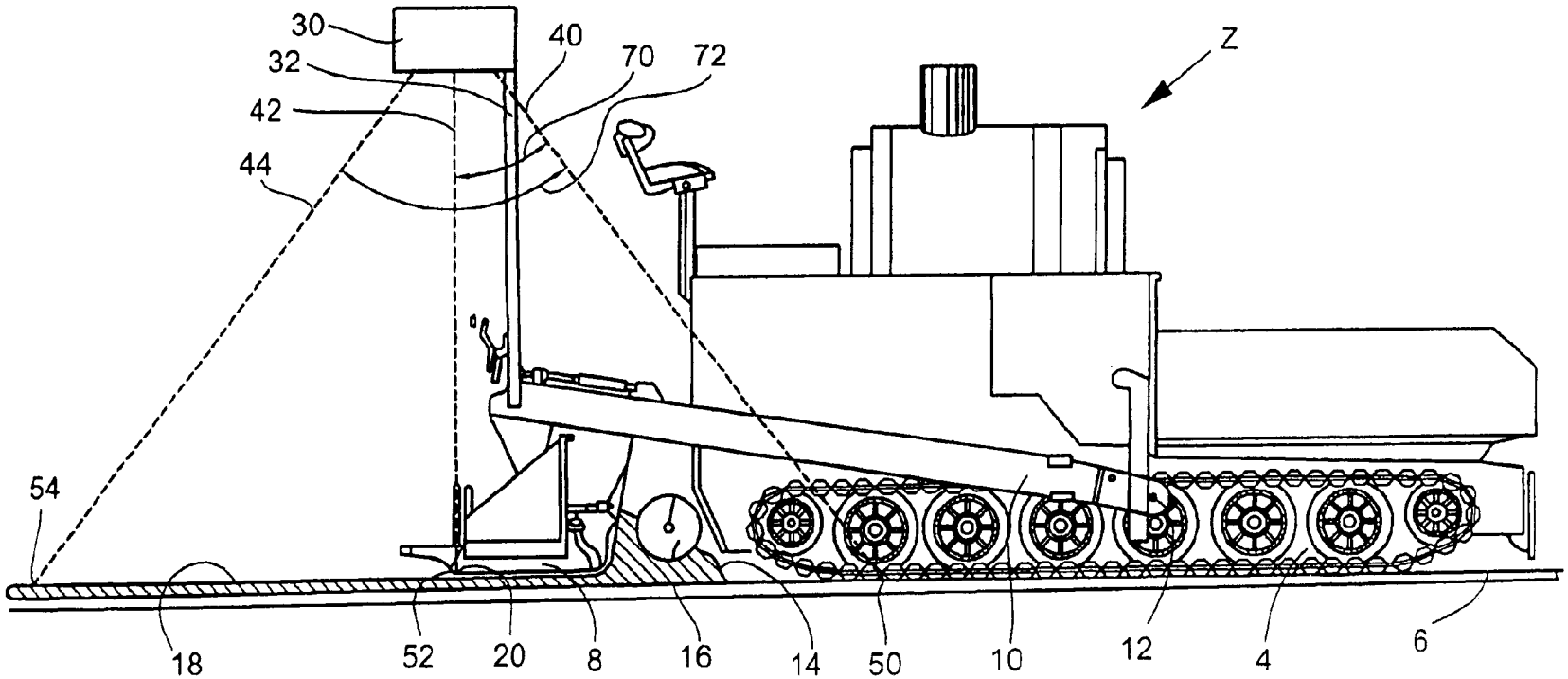
FIG. 1 shows a road finisher with the inventive laser-regulating means in accordance with a first embodiment.

FIG. 1 shows a road finisher 2 having a crawler track gear 4 on a prepared underground 6. At the rear end of the road finisher 2 opposing the driving direction, a height-adjustable plank 8 is arranged, which is mounted at a traction point 12 at the road finisher 2 by means of a traction arm 10. In front of the plank 8, there is a supply 14 of paving material kept essentially constant across the total width area of the plank 8 by a corresponding known regulation of the speed of a screw-like conveyor means 16.

The plank 8 floats on the paving material of a road surface 18 to be finished. The thickness of the road surface 18 to be finished prior to its final compaction by road compactors will be effected by regulating the height-position of the rear edge 20 of the plank 8. This height-regulation is induced by changing the blade angle of the plank 8 and is typically effected by controlling setting cylinders engaging into the front end of the traction arms 10.

The previously described road finisher 2 is in accordance with the road finishers in accordance with the state of the art such that, in consideration of expert knowledge on the present technical field, it is not necessary to go into a detailed description.

The road finisher 2 comprises a laser-regulating means in accordance with the present invention which is attached in a housing 30 via a mounting 32 at the traction arm 10. In the shown embodiment, the laser-regulating means includes three laser measuring heads not shown in FIG. 1, which direct three laser beams 40, 42 and 44 to three measuring points, 50, 52 and 54 on a reference surface 60 beside, in front of and/or behind the road finisher. As a result, the central laser measuring head is arranged vertically above the rear edge 20 of plank 8, such that the pertaining measuring point 52 lies on a straight line with the rear edge 20 of the plank 8. The first laser beam 40 and the second laser beam 42 include a first angle 70, the first laser beam 40 and the third laser beam 44 include a second angle 72. The reference surface may, for example, be established by an existing or just finished track of the road surface, an already finished kerb strip of the road or any other suitable surface.

Figure 2:
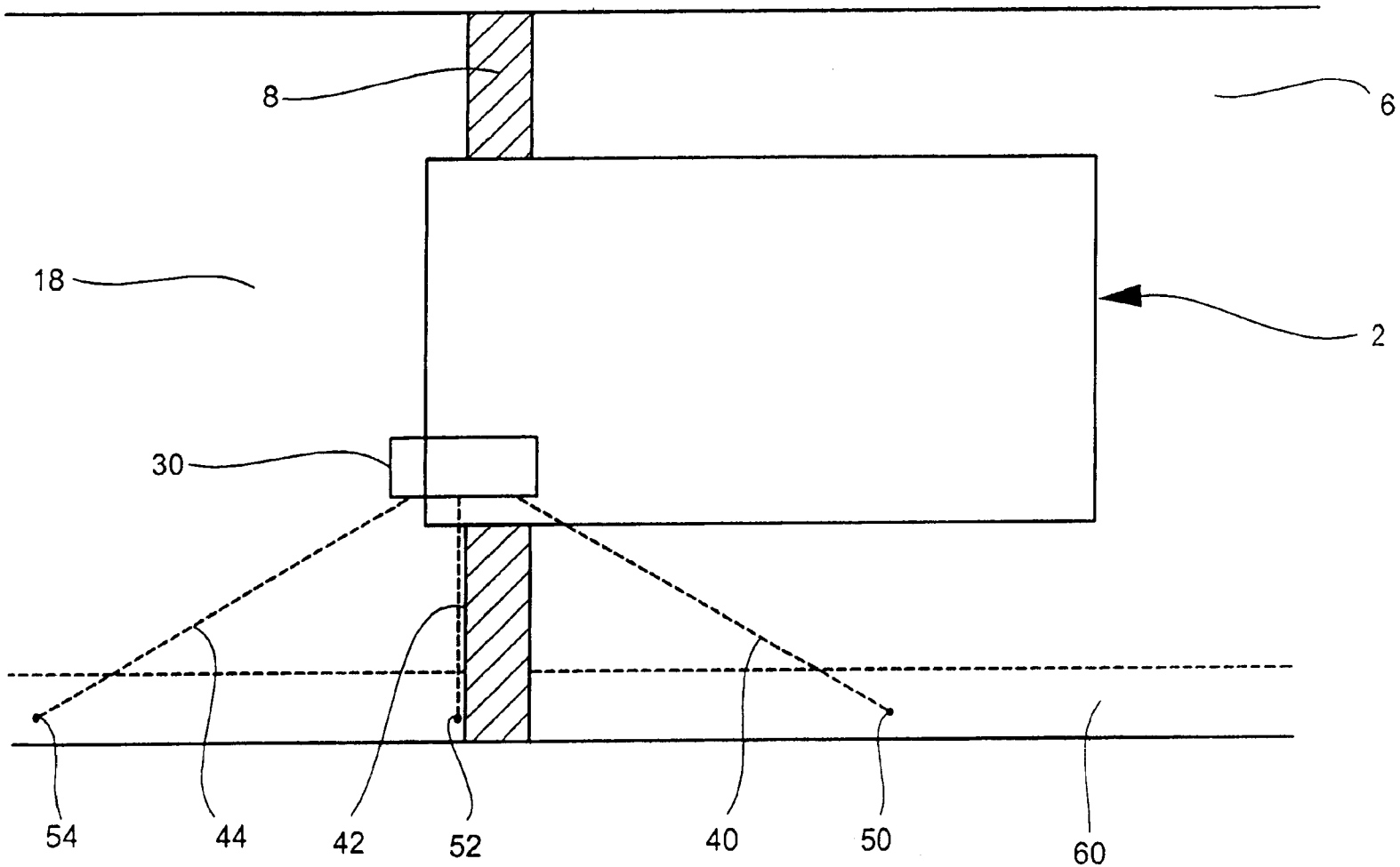
FIG. 2 shows a schematic plan view of the road finisher from FIG. 1.

FIG. 2 shows a schematic plan view of the road finisher 2 from FIG. 1. The laser beams 40, 42, and 44, respectively, of the laser measuring heads in housing 30, which are not shown, are directed to measuring points 50, 52, and 54, respectively. The first measuring point 50 and the second measuring point 52 lie on a reference surface 60, which is situated on the edge of the prepared underground 6 being provided with a road surface 18 while the road finisher is moving to the right. The third measuring point 54 lies on the edge of the finished road surface 18 and on a straight line with the first measuring point 50 and second measuring point 52. Using several laser beams 40, 42, 44 of several laser measuring heads enables a flexible arrangement of the measuring points 50, 52, 54, which is adapted to the conditions and requirements of the respective application field.

Figure 3:
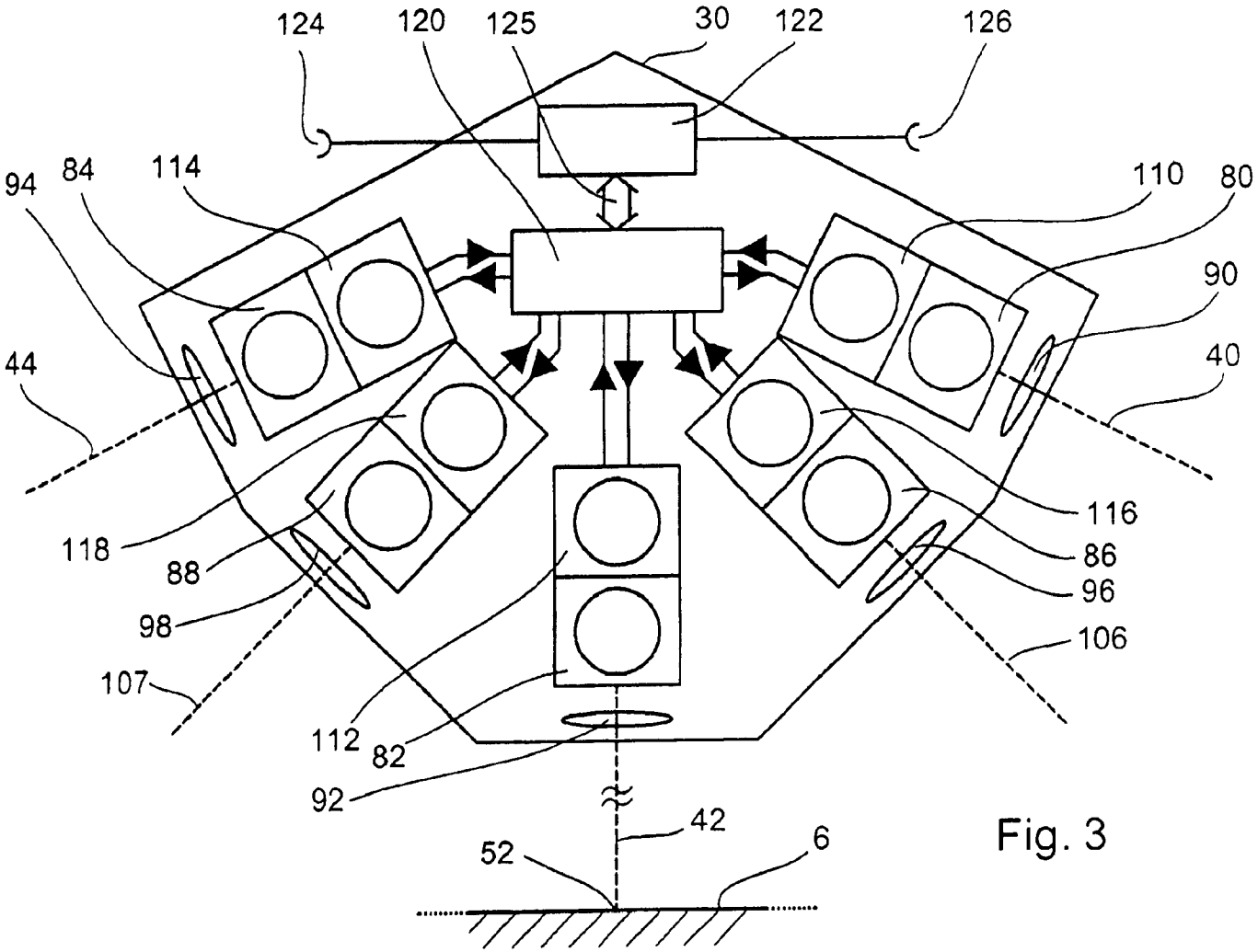
FIG. 3 shows a block diagram of the inventive laser-regulating means in accordance with a second embodiment.

In FIG. 3, an embodiment of the laser-regulating means is shown which, in contrast to the embodiment shown in FIG. 1, includes five laser measuring heads 80, 82, 84, 86, 88 each having one functionally related lens 90, 92, 94, 96, and 98, respectively. The laser measuring heads 80, 82, 84, 86, 88 emit laser beams 40, 42, 44, 106, 107, which are directed to the respectively pertaining measuring points. The laser-regulating means further includes a number of transceiver circuits 110, 112, 114, 116, 118 corresponding to the number of laser measuring heads 80, 82, 84, 86, 88. These transceiver circuits 110, 112, 114, 116, 118 are in a respective electrical signal-connection to respectively one of the laser measuring heads 80, 82, 84, 86, 88. The transceiver circuits 110, 112, 114, 116, 118 are further in an electrical signal-connection to an evaluating means 120, which, for example, may comprise a microcomputer. As is shown in FIG. 3, each of the transceiver circuits is connected to the evaluating means via two signal lines, with signals being sent to the transceiver circuit via one line and signals being received from the transceiver circuit via the other line, as is shown in FIG. 3 by the arrows associated with the lines. Via an interface 122 and a first terminal 124, the evaluating means 120 is connected to a non-illustrated apparatus for controlling the above mentioned setting cylinders attacking the front ends of the traction arms 10 in order to influence the height position of the rear edge 20 of the plank and, thus, the thickness of the road surface 18 to be finished. The connection between the evaluating means 120 and the interface 122 is schematically shown by the arrow 125 in FIG. 3. Via a second terminal 126, the evaluating means 120 is connected to a non-illustrated apparatus, where a user may first set a target value for the height-adjustment of the plank. Via a non-illustrated terminal, the members of the laser-regulating means are supplied with electrical power by a non-illustrated power source.

Each laser measuring head 80, 82, 84, 86, and 88, respectively, may be integrated with the respectively pertaining transceiver circuit 110, 112, 114, 116, and 118, respectively, in a component (as illustrated) and/or with the pertaining lens 90, 92, 94, 96, and 96, respectively. The transceiver circuit 110, 112, 114, 116, and 118, respectively, the laser measuring head 80, 82, 84, 86, and 88, respectively, and the lens 90, 92, 94, 96 and 98, respectively, cooperate to determine the distance of the laser measuring head 80, 82, 84, 86, and 88, respectively, from the respective measuring point on the reference surface 60 using the running time of the laser beam 40, 42, 44, 106, and 107, respectively, from the time of its emission by the laser measuring head 80, 82, 84, 86 and 88, respectively, to the time of receiving the laser light reflected from the reference surface 60 in the pertaining measuring points by the measuring head 80, 82, 84, 86, and 88, respectively, and to send an electrical signal corresponding to this distance to the evaluating means 120. From the thus determined distance of the laser measuring head 80, 82, 84, 86, and 88, respectively, and from its known geometric arrangement, the evaluating means 120 calculates its distance from the reference surface.

The classification of functionalities shown in FIG. 3 within the laser height regulating means merely represents an embodiment and may be varied, for example, by integrating various illustrated components in a component. Further, the laser height regulating means may comprise further, not-illustrated interfaces for exchanging data with other apparatuses, for example, other control and regulating apparatuses of the construction machine 2, with a central computer of the construction machine 2 or with an external computer for performing error diagnostics.

Depending on the respective special area of application of the laser-regulating means and the conditions and circumstances related to the same, the laser measuring heads 80, 82, 84, 86, 88, or the laser beams 40, 42, 44, 106, 107 emitted by the same, are spatially aligned such, that the respective measuring points are spaced from each other as far as possible, that is, that, for example, the first angle 17 between the first laser beam 40 and the second laser beam 42, and the second angle 72 between the first laser beam 40 and the third laser beam 44 are chosen as great as possible.

From the distances of the laser measuring heads 80, 82, 84, 86, 88 relative to reference surface 60 and the known geometric arrangement of the laser measuring heads 80, 82, 84, 86, 88 with respect to the plank 8, the evaluating means 120 determines the height of the plank 8 relative to the reference surface 60. From this height of the plank 8 relative to the reference surface 60 as well as from a target height, which can be adjusted at the above-mentioned, not-illustrated apparatus connected to the evaluating means 120 via the terminal 122, the evaluating means 120 determines a height-control signal for the plank 8. At the road finisher 2, this height-control signal serves for controlling the setting cylinders for adjusting the front traction points 12 of the traction arms 10 of the plank 8.

In the following, preferred further processings of the detected signals from the laser measuring heads 80, 82, 84, 86, 88 by the evaluating means 120 for generating the height-control signal will be described.

From the distances of the laser measuring heads 80, 82, 84, 86, 88 relative to the reference surface 60, which have been determined from the output signals of the laser measuring heads 80, 82,. 84, 86, 88, the evaluating means 120 forms a mean value to determine the height of the plank 8 relative to the reference surface 60. By means of averaging, the influence of a waviness of the reference surface 60 onto the height-control signal is reduced and, thus, a better evenness, or smoothness, of the just finished road surface 18 will be achieved. This averaging functions the better, the more laser measuring heads 80, 82, 84, 86, 88 or measuring points 50, 52, 54, 108, 109 are present on the reference surface 60 and the further the measuring points 50, 52, 54, 108, 109 are spaced from each other on the reference surface 60.

Further, the evaluating means 120 may be implemented such that the evaluating means 120 discards a distance of a laser measuring head 80, 82, 84, 86, 88 from the reference surface 60 as invalid and does not use the same for generating the height-control signal, if the distance involved lies outside a predetermined range. As a result, it is possible, for example, to suppress the undesired transmission of various errors of the reference surface 60 to the road surface 18 to be finished. The predetermined range may be defined by a lower limiting value and an upper limiting value for the distance of a laser measuring head 80, 82, 84, 86, 88 from the reference surface 60. The errors of the reference surface 60 include, for example, holes, stones or other objects lying on the reference surface 60, and the influence of which onto the height-regulation of the plank 8 is mitigated, but not eliminated by the above-described averaging. The upper limiting value and the lower limiting value are selected such that a waviness of the reference surface 60 is still within the range defined by the upper limiting value and the lower limiting value in order not to discard too many measuring points 50, 52, 54, 108, 109 as invalid and such that the most objects and holes on or in the reference surface 60 or the distances generated by these ranges are outside the range in order not to have any influence on the height regulation of the plank 8. The precise values of both limiting values are dependent on the respective circumstance, for example, on the quality of the reference surface 60 or a longitudinal curvature of the reference surface 60 or the road surface 18 to be finished as well as on the spatial arrangement of the measuring point 50, 52, 54, and, during use, may be manually or automatically adapted to the respective circumstances.

The just described range, outside of which one of the determined distances may be discarded or is not used for generating the height-control signal, may be specified in a laser height-regulating means having at least three laser measuring heads 60, 82, 84, 86, 88 by a range above/below the plane which is defined by the remaining distances. As a result, even in the case of a longitudinal curvature of the reference surface 60, the transfer of which to the road surface 18 to be finished is desired, a small predetermined range is adjusted, within which distances may be classified as valid and are not discarded.

In a further embodiment, instead of the limiting values or the remaining distances, the difference between two distances each is determined, and those distances are discarded as invalid and not used for generating the height-control signal, the differences of which exceed a predetermined limiting value as regards the distances of the other laser measuring heads 80, 82, 84, 86, 88 relative to the reference surface 60. Thereby, errors at the reference surface 60 are also identified and their influence on the height-control signal is eliminated.

The advantage of the laser measuring heads 80, 82, 84, 86, 88 as against conventional approaches using ultrasound measuring heads consists in that, in contrast to ultrasound measuring heads, no vertical irradiation on the reference surface 60 and no small distance to the same is required. Under normal circumstances, that is, in case of a not too strongly reflective reference surface 60, the laser measuring heads 80, 82, 84, 86, 88 may also be used at great angles to the perpendicular and at a great distance to the reference surface 60. Therefore, it is possible to arrange all laser measuring heads 80, 82, 84, 86, 88 largely independent of the arrangement of the pertaining measuring points on the reference surface 60. Especially, as is shown in FIG. 3, all laser measuring heads 80, 82, 84, 86, 88 may be arranged together with the evaluating means 120 and the interface 122 in a common housing 30, which is mounted at the road finisher 2 at a height relative to the road which essentially corresponds to the height of the road finisher 2. As a result, the mechanical-constructive requirements for mounting the regulating means are significantly reduced. Further, the risk of damaging the regulating means in rough field conditions as well as the probability of preventing construction site workers from performing activities at the road finisher 2 and in the immediate vicinity of the same is diminished.

Further, the laser measuring heads 80, 82, 84, 86, 88, which may be adjusted in their spatial orientation as needed, but which are immovable during operation, avoid the disadvantages of a laser scanner being moveable during operation and comprising a sensitive mechanic. By completely dispensing with moveable parts, especially under the extreme conditions at a construction machine 2 (vibrations, very large working temperature range, humidity, etc.), reduced error-proneness, lower failure times, longer service life, and better efficiency are possible.

Figure 4:
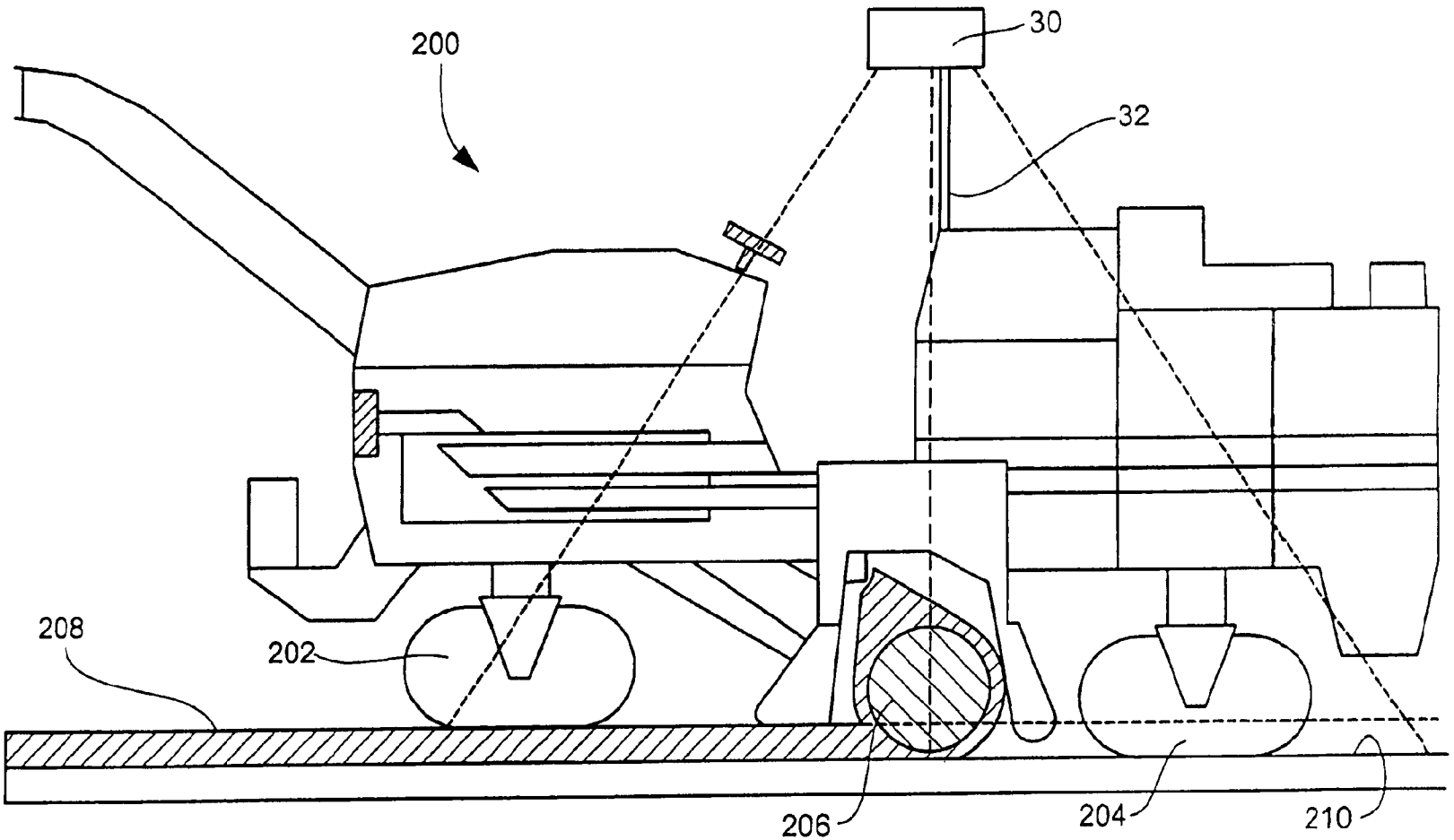
FIG. 4 shows a cold planer with the laser-regulating means in accordance with the first embodiment.

The road finisher 2 specified in the previous embodiments, is only an example for a construction machine where the is laser-regulating means may be used to regulate the height of a height-adjustable machining tool, such that the finished surface comprises a desired profile. A further example is the cold planer 200 illustrated in FIG. 4 having a front gear 202 and a rear gear 204, at least one of which is adjustable in height. The machining tool is in this case a milling drum 206, the height of which, and thus also the "cutting depth", may be adjusted relative to a not machined track 208 and a machined track 210, by adjusting the height-adjustable gear 202 or 204 or, if applicable, by adjusting the height of at least one of the height-adjustable gears 202, 204. In the cold planer 200, the laser-regulating means already described by means of FIG. 1 is mounted via the mounting 32 in the housing. As a result, one of the laser measuring heads is aligned with the pertaining measuring point and the axis of the milling drum (206). The height-control signal generated by the laser-regulating means controls the height-adjustment of the gear 202, 204.

Further, the use of the laser-regulating means in accordance with the present invention is possible with each construction machine which changes the profile of a surface, i.e. which removes or applies layers, to obtain a desired profile and, in the process, references to a reference surface. Under certain circumstances, this may include a bulldozer, a so-called motor grader etc.

What is claimed is:

1. Laser-regulating means for a construction machine for adjusting the height of a height-adjustable machining tool, comprising a first laser measuring head, a second laser measuring head, and a third laser measuring head, which are arranged at the construction machine, with the first laser measuring head and the second laser measuring head being arranged at a first angle to each other, with the first laser measuring head and the third laser measuring head being arranged at a second angle to each other, with the first angle and the second angle being selected such that a first measuring point of the first laser measuring head, a second measuring point of the second laser measuring head, and a third measuring point of the third laser measuring head are spaced from each other on a reference surface, with the first measuring point, the second measuring point, and the third measuring point being arranged essentially behind each other in the direction of motion of the construction machine; and an evaluating means, which, depending on output signals of the first laser measuring head, the second laser measuring head, and the third laser measuring head, determines a first distance of the first laser measuring head from the reference surface, a second distance of the second laser measuring head from the reference surface, and a third distance of the third laser measuring head from the reference surface, on the basis of the determined distances and the known geometric arrangement of the first laser measuring head, the second laser measuring head, and the third laser measuring head relative to the machining tool, calculates the height of the machining tool relative to the reference surface and, depending on the calculated height and a target height, generates a height-control signal for the machining tool.

2. Laser-regulating means in accordance with claim 1, including a fourth laser measuring head and a fifth laser measuring head, with the fourth laser measuring head being arranged at the construction machine at a third angle relative to the first laser measuring head, with the fifth laser measuring head being arranged at the construction machine at a fourth angle relative to the first laser measuring head, with the third angle and the fourth angle being selected such that the first measuring point, the second measuring point, the third measuring point, a fourth measuring point of the fourth laser measuring head, and a fifth measuring point of the fifth laser measuring head being spaced from each other on the reference surface and that the first, second, third, fourth and fifth measuring point lie essentially behind each other in the direction of motion of the construction machine, with the evaluating means further calculating the height of the machining tool depending on a fourth distance of the fourth laser measuring head relative to the reference surface, a fifth distance of the fifth laser measuring head relative to the reference surface, and the known geometric arrangement of the fourth laser measuring head and the fifth laser measuring head with respect to the machining tool.

3. Laser-regulating means in accordance with claim 2, wherein on the basis of the first, second, third, fourth, and fifth distance the evaluating means determines differences of two distances thereof, and classifies those distances as valid, the differences of which are smaller than a threshold value.

4. Laser-regulating means in accordance with claim 1, wherein the evaluating means discards one of the determined distances as invalid and does not use the same for generating the height-control signal, if the respective distance lies outside a predetermined range.

5. Laser-regulating means in accordance with claim 4, wherein the predetermined range is specified by a predetermined distance above/below a plane, with the plane being specified by the remaining distances.

6. Laser-regulating means in accordance with claim 1, wherein the evaluating means averages the determined distances.

7. Laser-regulating means in accordance with claim 1, wherein the laser measuring heads are adjacent to each other in spatial proximity, and are arranged essentially behind each other in the direction of motion and essentially at equal distances to the machining tool.

8. Laser-regulating means in accordance with claim 1, wherein one of the laser measuring heads is aligned with the pertaining measuring point and the machining tool.

9. Laser-regulating means in accordance with claim 1, wherein the construction machine is a road finisher, and the machining tool is a plank, which is connected to the road finisher via a traction arm, with the laser measuring heads being mounted via a mounting to the traction arm in a common housing, with the height-control signal generated by the evaluating means causing an adjustment of the traction arm of the plank.

10. Laser-regulating means in accordance with claim 1, wherein the construction machine is a cold planer having a front and a rear gear, at least one of which is height-adjustable, and wherein the machining tool is a mill, with the laser measuring heads being mounted in a common housing via a mounting to the cold planer, with the height-control signal generated by the evaluating means causing a height-adjustment of the front and/or rear gear.

11. Laser-regulating means in accordance with claim 9, wherein one of the laser measuring heads being aligned with the pertaining measuring point and the rear edge of the plank.

12. Laser-regulating means in accordance with claim 10, wherein one of the laser measuring heads is aligned with the pertaining measuring point and the axis of the milling drum.

13. Laser-based controller for adjusting the height of a machining tool of a construction machine, the controller comprising a first laser measuring head;

a second laser measuring head;

a third laser measuring head;

wherein the first laser measuring head is configured to emit a first laser beam, the second laser measuring head is configured to emit a second laser beam under a first angle with regard to the first laser beam, and the third laser measuring head is configured to emit a third laser beam under a second angle with regard to the first laser beam, wherein the first angle and the second angle are selected such that a first, second and third measuring point of the first, second and third laser measuring head are arranged spaced from each other and behind each other in the direction of motion of the construction machine on a reference surface, and wherein the laser measuring heads are arranged adjacent to each other in spatial proximity above the adjustable machining tool; and an evaluating means configured to determine, on the basis of output signals from the first, second and third laser measuring heads, a first distance of the first laser measuring head from the reference surface, a second distance of the second laser measuring head from the reference surface, and a third distance of the third laser measuring head from the reference surface, wherein the evaluating means is further configured to calculate, on the basis of the determined distances and the known geometric arrangement of the first, second and third measuring head relative to the machining tool, the height of the machining tool relative to the reference surface, and wherein the evaluating means is further configured to generate, on the basis of the calculated height and a target height, a height-control signal for the machining tool.

* * * * *